United States Patent [19]

Crane

[11] 3,935,991

[45] Feb. 3, 1976

[54] PLASTIC REINFORCED PRODUCE CONTAINER

[75] Inventor: Walton B. Crane, Sherman Oaks, Calif.

[73] Assignee: A & E Plastik Pak Co., Inc., City of Industry, Calif.

[22] Filed: Mar. 17, 1975

[21] Appl. No.: 559,088

Related U.S. Application Data

[60] Division of Ser. No. 307,962, Nov. 20, 1972, Pat. No. 3,878,980, which is a continuation-in-part of Ser. Nos. 193,874, Oct. 29, 1971, abandoned, Ser. No. 227,798, Feb. 22, 1972, abandoned, and Ser. No. 238,320, March 27, 1972, abandoned.

[52] U.S. Cl. ..... 229/34 R; 217/69; 229/23 R; 229/44 R; 229/49

[51] Int. Cl.[2] ..... B65D 61/00

[58] Field of Search ..... 229/23 R, 23 A, 34 R, 49, 229/44 R, 45; 217/69

[56] References Cited

UNITED STATES PATENTS

| | | | |
|---|---|---|---|
| 3,373,921 | 3/1968 | Crane | 229/23 R |
| 3,409,202 | 11/1968 | Belcher | 229/45 |
| 3,417,909 | 12/1968 | Stern | 229/23 R |
| 3,485,433 | 12/1969 | Rapp | 229/23 R |
| 3,632,037 | 1/1972 | Webb | 229/23 R |
| 3,713,579 | 1/1973 | Chaffers | 229/44 R |
| 3,820,706 | 6/1974 | Gibson et al. | 229/34 R |
| 3,987,991 | 1/1970 | Stern | 229/44 R |

*Primary Examiner*—William Price
*Assistant Examiner*—Bruce H. Bernstein
*Attorney, Agent, or Firm*—Forrest J. Lilly

[57] ABSTRACT

A reinforced paperboard produce container having reinforcing end frames of molded thermosetting plastic or other suitably rigid construction secured to the outer sides of the end walls of a paperboard container body with edge flanges on the frames projecting inwardly over the upper end wall edges and under the bottom wall of the body to provide upper and lower stacking edges. The reinforced containers are of sufficient strength, and interfit in such manner, that a number of them may be stacked with ample strength and stability in vertical columns. The lower stacking edges are recessed or bevelled to permit lifting of the container by a clamp truck. The container has hinged lids or cover panels formed with tabs which engage with formations on the end frames to alternatively releasably lock the lids in closed, or open, folded away positions. The containers replace wood containers previously used, and incorporate useful arrangements for latching the lids closed, for shipment, or open, for display of the produce.

3 Claims, 13 Drawing Figures

PLASTIC REINFORCED PRODUCE CONTAINER

RELATED APPLICATIONS

This is a division of my co-pending application Ser. No. 307,962, filed Nov. 20, 1972, entitled PLASTIC REINFORCED PRODUCE CONTAINER, now U.S. Pat. No. 3,878,980, which in turn is a continuation-in-part of Ser. Nos. 193,874, filed Oct. 29, 1971, 227,798, filed Feb. 22, 1972, and 238,320, filed Mar. 27, 1972, all now abandoned.

BACKGROUND OF THE INVENTION

1. Field of the Invention

The present invention relates generally to containers and more particularly to plastic end frames for box containers and also to such frames in combination with certain novel features of an improved container. 2. Description of the Prior Art Produce, such as peaches, oranges, etc., is commonly packed for handling, storage, shipment and display in wooden or fiberboard box containers often referred to as trays or lugs. During storage and shipment, these containers are often stacked in vertical columns. Lately, some efforts have been made to construct such containers of less rigid material such as corrugated or other paperboard, sometimes with rigid plastic ends, but in all cases of which we are aware, these either have not attained sufficient strength to be reliable, or have been impractical for some other reason.

SUMMARY OF THE INVENTION

The present invention overcomes the prior art problems by the use of improved rigid plastic end frames for box containers, whereby the material of the container can be of a material having less strength and rigidity than wooden or fiberboard containers. The containers to which the present invention applies have a container body with a bottom wall bounded along its edges by upstanding side and end walls, together with lids hinged to the upper edges of its side walls.

Applied over the ends of the container are rigid reinforcing frames of open rectangular configuration which are preferably unitary molded plastic shapes. These frames have coplanar flanges which seat against the outer surfaces of the walls, and flanges perpendicular to the coplanar flanges which fit snugly, like caps, over narrow end portions of the container. The hinged lids remain outside these caps, and partly for this purpose and for another which will appear later, are unconnected with the side walls along the hinge lines for the distance from the vertical edges of the side walls to points just past or inside the perpendicular flanges of the end frames. In the preferred form of the invention, an important feature is that the end edges of the lids are offset from the vertical end edges of the side walls by this distance, so as to clear a later mentioned spacer on the end frame, excepting for a later described locking tab which interengages with this spacer. The upper and lower perpendicular frame flanges provide, or have thereon means providing, interengageable substantially horizontal stacking surfaces such that a number of the containers may be stacked, frame against frame, in vertical columns. The flanged construction of the plastic end frames provides the latter with sufficient strength and rigidity in their vertical edgewise directions to withstand, without buckling or collapsing, the maximum stacking loads normally encountered when the containers are stacked in their filled condition. A feature of the invention is that no loading is borne by the side or end walls of the container. The end walls of the container abut against the coplanar flanges of the end frames, and are strongly riveted together, contributing unusual strength at this juncture.

The upper and lower perpendicular frame flanges are relatively thin, and have, respectively, substantially horizontal upwardly and downwardly facing exterior side surfaces thereon. Extending vertically outward from the exterior side of one of these upper and lower perpendicular flanges, preferably the upper flange, is a spacer means, which has thereon one of said substantially horizontal stacking surfaces, (which may be in one or more coplanar sections) which is thus spaced outwardly from the correspondingly facing exterior side surface of the flange. The oppositely facing stacking surface is then the aforementioned substantially horizontal exterior surface on the other of these upper and lower perpendicular flanges.

The spacer means provide for air ventilation between stacked containers, and also provide space to receive the bottom walls of the containers when they sag under load. The much preferred arrangement is with the spacers rising above the upper perpendicular flanges, since the bottoms of the end frames and the containers can then be substantially coplanar, and can ride easily over roller conveyors.

Further features of the preferred form of the invention are that the end edges of the hinged lids have no portions which overlie the horizontal stacking surfaces on the spacers, but do have portions which overlie portions of the upwardly facing horizontal surface area of the upper perpendicular flanges, immediately inwardly of the spacers, and are received, in a lid-locking manner, in throats formed in said spacers. The result is that no edge portion of the lid can intervene between the elevated stacking surface on the end frame and the lower stacking surface on the end frame of the next container above.

It should be understood that where the container material is corrugated paperboard, it is subject to shrinkage in dry weather, swelling in moist weather, to crushing somewhat under heavy loading, etc., if plies of the paperboard intervene between stacking surfaces on adjacent end frames. Such intervening plies, of variable and uncertain thickness, would interfere with good stacking, particularly with stacks of eight or nine containers. Better stacking is thus obtained with the invention of the present application.

According to a further feature of the invention, the lower stacking edges are disposed a small distance below the bottom of the container body and are recessed at the bottom, or bevelled, to receive the blades of a clamp truck for convenient handling.

A further feature is that the volume of plastic material used is minimized for the strength obtained, and the cost of manufacture is thus minimized.

A further feature in the combination of end frame and container are score lines across the corners of the lids, whereby these corner portions bend to facilitate locking engagement of tabs on the lids into slots in the frame in either closed or open positions of the lids.

The objects and advantages of the present invention will be best understood from the following description of the embodiments of the invention disclosed in the accompanying drawings, in which.

DETAILED DESCRIPTION OF AN ILLUSTRATIVE EMBODIMENT

The reinforced paperboard container 10 has a body 12, and rigid reinforcing end frames 14 made of a molded thermoplastics material. Body 12 can be of any material, and can be less rigid than wood or fiberboard. Without limitation thereto, the invention will be described where the container is constructed from a blank 16 of corrugated paperboard or other suitable paperboard material. The blank 16 is folded in the manner illustrated in FIG. 2 to its final shape of FIG. 1. Plastic end frames 14 are then applied over and secured to the ends of the body, but with the presently mentioned hinged lids of the container outside the end frame.

Figure 2:
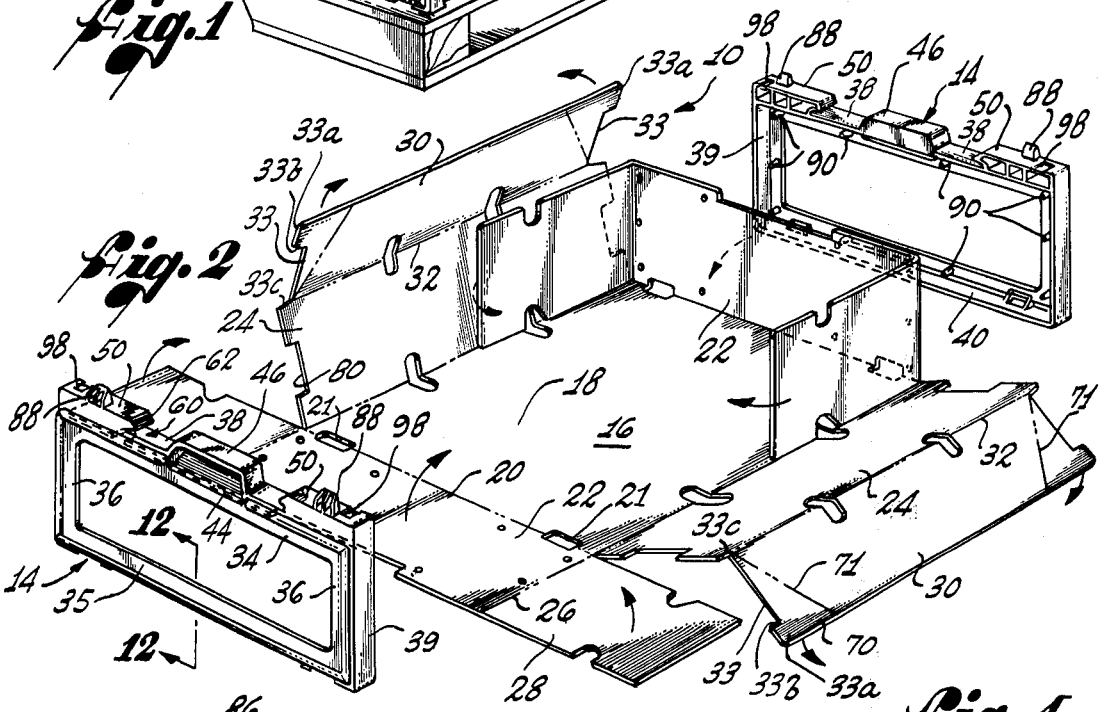
FIG. 2 is a perspective exploded view of an end frame which is to fit over a container end, showing the location of certain securing elements in a preferred form of the invention.
Figure 5:
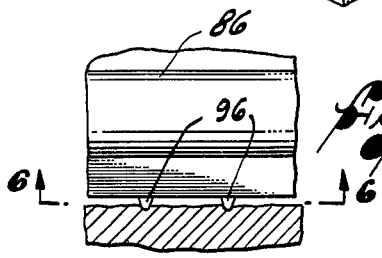
FIG. 5 shows, to an enlarged scale, a portion of the underside of an end frame enclosed within the circle 5 of FIG. 4.
Figure 6:
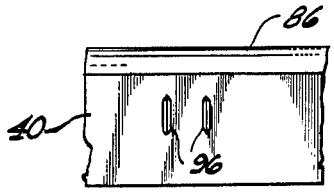
FIG. 6 is a detail section taken in accordance with the lines 6—6 of FIG. 5.
Figure 4:
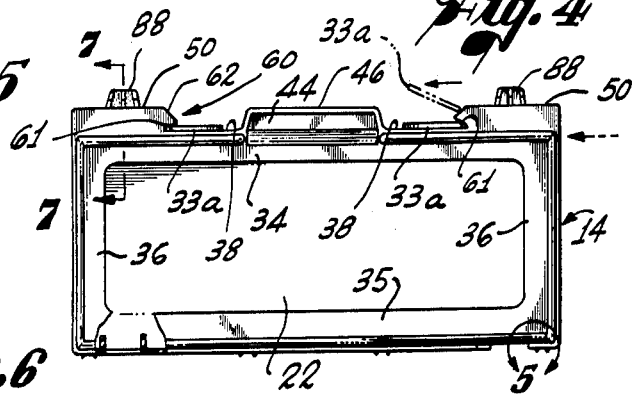
FIG. 4 is an end elevational view of the assembled produce container.
Figure 7:
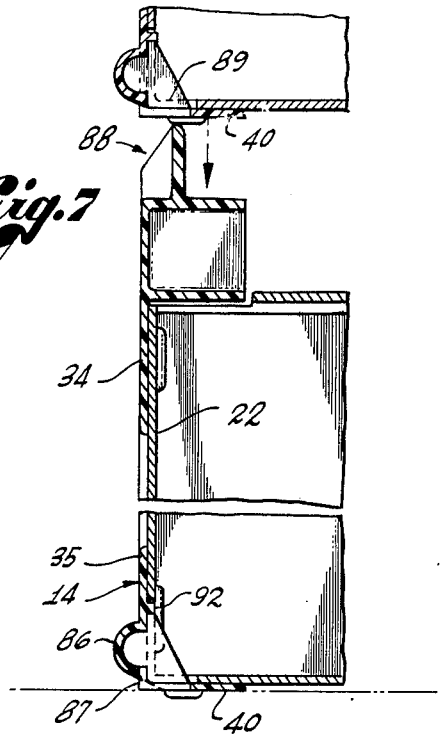
FIG. 7 is a transverse sectional view of one of the ends of a container, showing a container immediately above about to be lowered on the first container.
Figure 13:
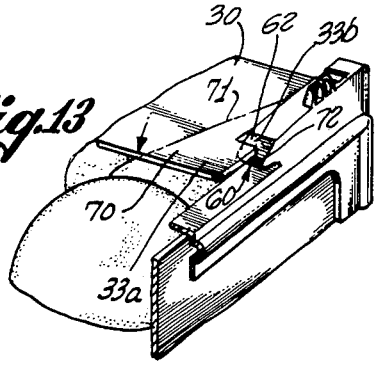
FIG. 13 is a fragmentary perspective view showing a portion of a lid in course of being engaged with a hold-down hook.
Figure 8:
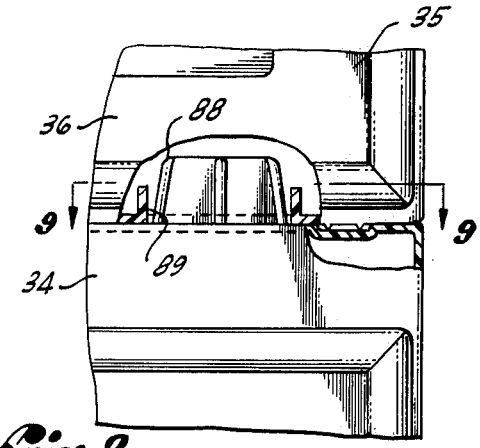
FIG. 8 is an enlarged detail of the upper right hand corner portion of the container as seen in FIG. 4, with the lower right hand corner portion of a container immediately above shown thereon, parts being broken away to reveal underlying portions in section.

Referring to FIG. 2, the container blank 16 has a rectangular bottom wall 18 with end and side edges. Joined to these edges of the bottom wall along scored or creased fold lines 20 are end walls 22 and side walls 24. Joined to the ends of the end walls 22 along fold lines 26 are flaps 28. A pair of slots 21 intercept each fold line 20. Lids 30 are hinged to the upper edges of the side walls 24 along hinge lines 32. The end edges 33 of these lids are offset from the vertical end edges of the side walls 24 by a distance which is substantially equal to or slightly greater than the widths of the end frames 14. Thus, there are shoulders at 33*c*, which are substantially extensions of hinge line 32, though preferably with a slight downward slope, along which the lids 30 are unconnected with the side walls 24. At the swinging corners of the hinged lids are locking tabs 33*a* which may project substantially to the plane of the end walls of the container, forming locking shoulders 33*b*.

The container blank 16 is erected by folding the end walls 22 upwardly and folding the end wall flaps 28 inwardly normal to the end walls. The side walls 24 are then folded upwardly against and adhesively bonded to the inwardly folded flaps 28. The lids 30 are foldable on their hinge lines 32 to closed positions over the open top of the container body.

Each end frame 14 comprises a rectangular integral structure embodying four coplanar flanges, an upper flange 34, a lower flange 35, and side flanges 36, which overlie marginal portions of the end walls of the container, and engage flat thereagainst. In addition, the frames 14 include four flanges 38, 39 and 40 extending perpendicularly from the outer edges of the flanges 34, 35 and 36, the flange 38 being an upper flange, flanges 39 being side flanges, and flange 40 being a lower flange. These snugly fit on over limited end portions of the bottom and side walls of the container, and go on over the end walls 22, forming end caps. The lids 30 remain outside.

The lower perpendicular flange 40 preferably is virtually flat throughout its length, so that the bottom of the container is substantially flat, and therefore capable of running on conventional roller type conveyors.

Centrally located on and extending vertically upward from a substantially horizontal upwardly facing exterior surface on the upper side of the upper perpendicular flange 38 of each end frame 14 is a spacer means 46 whose top forms a substantially horizontal, elevated stacking surface, and which is cored out to form a horizontally disposed recess 44. The recess opens outwardly and serves as a handle, giving proper room for the fingers. The spacer structure 46 is of the same width as the upper frame flange 38. Its top surface constitutes a support for the bottom perpendicular flange 40 of the end frame 14 of the container just above in a vertical stack of such containers.

The aforementioned spacer 46 occupies a central position on top of the flange 38, extending for a distance as shown along the flange 38. Occupying opposite end portions of the flange 38, and spaced from opposite ends of the spacer 46, are elevated spacers 50, with flat horizontal tops forming substantially horizontal stacking surfaces coplanar with that at the top of spacer 46, and cored out, as seen in FIG. 2.

Thus, a given container, when stacked on a container below, will have the substantially horizontal lower exterior surface on the lower side of its lower flange 40 in engagement with and resting upon the three spacers 46 and 50. It thus comprises the lower stacking surface of the end frame.

The weight of a stack of containers is thus transferred through the plastic end frames of the containers, specifically, from the bottom flange 40 of each container end frame to the spacers 46 and 50 on the top flange 38 of the end frame of the container immediately below. The plastic end frames of the invention as described possess very high strength in vertical compression, resulting in a correspondingly high stacking capacity.

The ends of the spacers 50 confronting the handle 44 have hook-forming projections 60, forming therebelow a tapered throat 61, which are adapted to engage over and receive the opposed shoulders 33*b* formed by locking tabs 33*a*, projecting laterally from the end edges 33 of cover panels 30. The end edges 33 extend alongside the spacers 50 to meet shoulders 33*c* which are approximately aligned with hinge line 32 and are formed along the top edge of each side wall 24 outwardly of the lids 30. The upper portions of the hook-forming projections 60 are tapered forwardly, as at 62, to facilitate forcing of the cover panel tabs down to a position over the extremity of the projections 60, from where they are retracted back into the throat 61.

Figure 10:
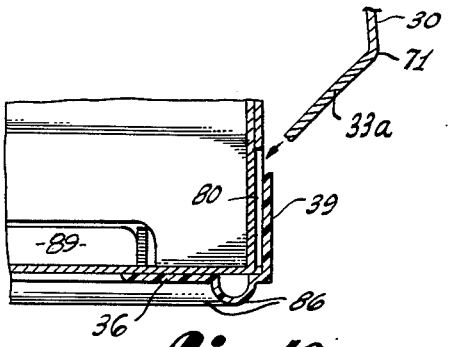
FIG. 10 is an enlarged detail section taken in accordance with the line 10—10 of FIG. 1.
Figure 9:
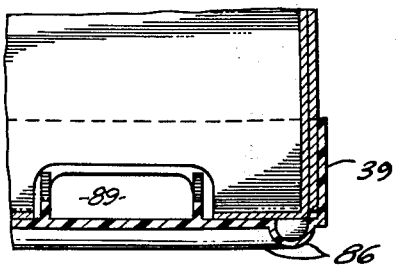
FIG. 9 is a detail section taken on line 9—9 of FIG. 8.
Figure 11:
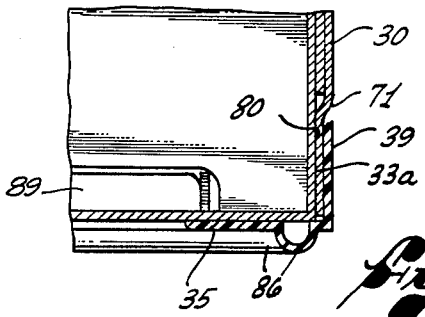
FIG. 11 is a view similar to FIG. 10, but showing a lid flap engaged in a slot in the container structure.
Figure 12:
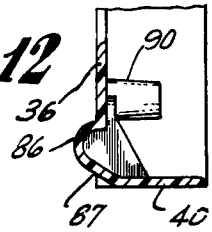
FIG. 12 is a section taken on line 12—12 of FIG. 2.

To facilitate engagement of said tabs into a retention slot in an alternate position of the lid, (FIGS. 1, 10 and 11), the corner portion 70 of each lid 30 is scored to form a score line 71 from a point a few inches inward along the longitudinal edge of the lid to the intersection of the lid edge 33 with the shoulder 33*c*. This score line 71 is made on the underside, or reverse side, of the blank when the blank is viewed in the aspect of FIG. 2. Considering the nearer lid 30 of the upper container, in the position of FIG. 1, the corner portion 70 then tends to bend downward and inward at the score line 71, toward the side of the container, so as to be capable of easy entry into the later described slots 80.

Now, when the lids or top panels are to be folded in and over a filled carton, the tab 33*a* of each corner portion 70 of the lid engages the tapered tip of the projection 60, and by pressing downwardly on the corner portion of the lid just outwardly thereof, the tab slides down the incline and into the throat 61. The side walls 32 are also manually flexed inwardly a short distance, and by the combination of these movements the tabs pass over and under the crest of the member 60, and, by release of the flexing pressure on the side wall of the box, the tabs 33*a* are drawn back into the tapered throats 61. By having the lids 30 unconnected from the side walls 24 along the shoulders 33*c*, the lid may be displaced laterally a little better and further while pulling it to engage the lid tabs 33*a* over the locking extremities of the spacers 50.

During filling of the lugs, and later while on market display, it is important to get the lids 30 out of the way. By the present invention, the lids are folded out and down, alongside the sides of the box, and the tabs 33*a* are inserted in slots 80 positioned to receive them. To provide these slots, notches 80' are cut in the vertical edges of the side walls 24. The tabs 33*a*, helped by the bends at 71, are easily insertible in the slots 80, and the side walls are thus held neatly and snugly against the sides of the container.

Figure 1:
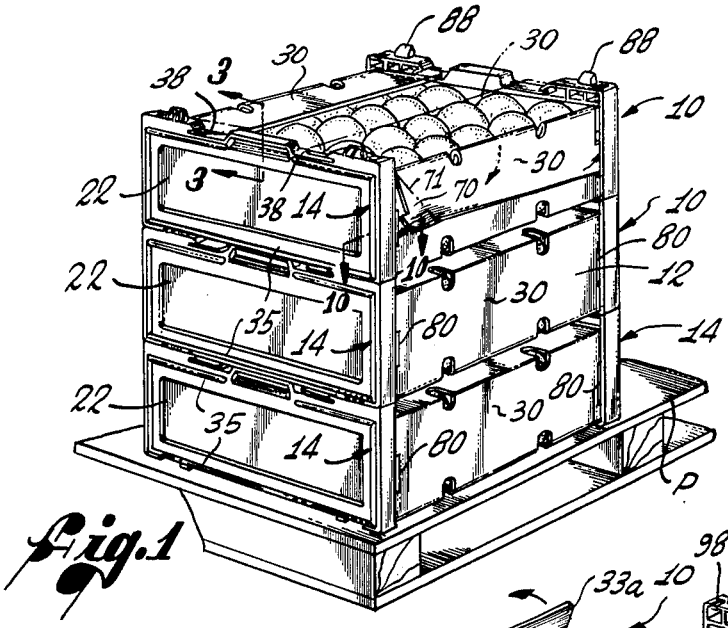
FIG. 1 is a perspective view of three stacked containers having the end frames of the present invention.
Figure 3:
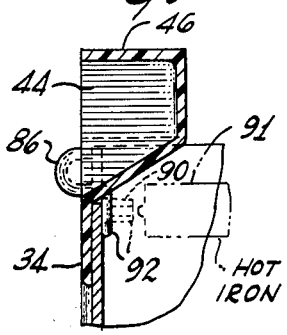
FIG. 3 is an enlarged detail section taken on the line 3—3 of FIG. 1.

On each end frame, running entirely around the flanges 34, 35 and 36, excepting at the location of the handle, is a rounded bead 86, which serves as a buffer against containers of an adjacent stack. The underside of the bead on the lowermost flange leads to a bevelled surface 87, which facilitates penetration by the blades of a conventional clamp truck by which a carton can be conveniently lifted from the floor, or from a pallet P such as shown in FIG. 1.

Projecting upwardly from each of the spacers 50 is a tapering positioning prong 88, adapted for reception, with small clearance, in an aperture 89 formed in the lower flange 40 of an end frame immediately above. The paperboard box structure is apertured at 21 suitably to permit entrance of these prong structures.

An improved especially secure fastening means is provided for securing the coplanar flanges of the end frames 14 to the ends of the container body. Lugs or rivets 90, preferably in the form of slightly tapered projections, are formed integrally with and project inward from these coplanar flanges, and penetrate holes formed in the box ends. These are then heated and made plastic by a heating iron 91, which is then forced inwardly against the projection so as to form it with a head 92. A very secure fastening is thereby accomplished, and the container has improved rigidity.

One further improvement is made to prevent skidding of the containers when resting on a wooden pallet, floor, or the like. On the bottom flanges 40 are formed sets of serrations 96, which, being hard, and relatively narrow, dig into a wooden or composition floor under the weight of a stack of containers sufficiently to prevent lateral displacement. On the top surfaces of the spacers 50, above these serrations, is a slightly depressed area 98, so that the serrations on the underside of one end frame will not dig into or engage the top surface of the spacer 50 of the end frame immediately below.

What is claimed is:

1. In a generally rectangular container with rigid rectangular, reinforcing end frames at opposite ends thereof, the container having rectangular bottom, opposed side and end walls, and lids which are respectively hinged to the upper edges of said opposed side walls, said rectangular end frames comprising integral, coplanar, upper, lower and side flanges parallel with the end walls of the container and lying thereadjacent, and rectangular integral upper, lower and side flanges, integral with and projecting perpendicularly from said coplanar flanges from the outer margins thereof, whereby to provide reinforcing caps receiving therein the corresponding end walls of the container and end portions of said bottom walls, with the perpendicular side flanges thereof lying closely adjacent said side walls of said container:

horizontal upwardly facing and downwardly facing surface areas formed on the exterior sides of said upper and lower perpendicular flanges, the upwardly facing surface areas on said upper perpendicular flanges being at substantially the level of the underside of the hinged lids when said lids are closed, and said lids having substantially coplanar tabs which project laterally and overlie said upwardly facing surface area on said upper perpendicular flanges, two hooks mounted on the upper perpendicular flange of each end frame, said hooks facing toward one another, and said laterally projecting tabs having edge shoulders facing generally in the direction of the hinge line of the corresponding lid and being adapted for engagement in the throats of said hooks, and said edge shoulders, when unengaged with said hooks, normally falling short of the forward extremities of said hooks, and thereafter recede into said throats by resilient return flexure of said side wall when said manual stress is relieved.

2. The subject matter of claim 1, wherein:

said throats of said hooks taper inwardly and downwardly and lead to portions of said horizontal upwardly facing area on said upper perpendicular flange.

3. The subject matter of claim 1, including:

tapered surfaces on the ends of said hooks, over said throats, to facilitate entry of said lid tabs downward and into said throats.

* * * * *